United States Patent [19]

Watson et al.

[11] Patent Number: 4,685,137

[45] Date of Patent: Aug. 4, 1987

[54] MICROPHONE WITH NON-SYMMETRICAL DIRECTIVITY PATTERN

[75] Inventors: Alan R. Watson; Michael A. Bryson, both of Buchanan, Mich.

[73] Assignee: Electrovoice, Inc., Buchanan, Mich.

[21] Appl. No.: 735,400

[22] Filed: May 17, 1985

[51] Int. Cl.[4] ..... H04R 19/04; H04R 1/20

[52] U.S. Cl. ..... 381/174; 381/155; 381/158; 381/159

[58] Field of Search ..... 179/121 D, 121 R, 111 E, 179/140, 180, 187, 111 R; 381/155, 168, 159, 174, 158, 169

[56] References Cited

U.S. PATENT DOCUMENTS

| | | | |
|---|---|---|---|
| 4,117,275 | 9/1978 | Miyanaga et al. | 381/174 |
| 4,258,235 | 3/1981 | Watson | 179/121 D |
| 4,268,725 | 5/1981 | Nakawaga et al. | 179/111 E |
| 4,456,796 | 6/1984 | Nakawaga et al. | 179/111 E |

FOREIGN PATENT DOCUMENTS

| | | | |
|---|---|---|---|
| 2558881 | 7/1976 | Fed. Rep. of Germany | 179/121 D |

OTHER PUBLICATIONS

Miura, Kenzo, Variable Acoustical Network for Microphone", *National Technical Report,* vol. 16, No. 3, Jun. 1970.

*Primary Examiner*—Gene Z. Rubinson
*Assistant Examiner*—Danita R. Byrall
*Attorney, Agent, or Firm*—Darby & Darby

[57] ABSTRACT

A microphone having unique polar response characteristics has a virtual axis of maximum pickup sensitivity which is angularly displaced from its physical horizontal longitudinal axis. Forward and rearward movement of a diaphragm is sensed by a sensing element mounted in spaced relationship to a rear side of the diaphragm. A substantially enclosed cavity is formed between the diaphragm rear side and the sensing element, with a non-symmetrical arrangement of at least one aperture for permitting sound pressure waves to enter said cavity, so that the polar response curve of the microphone in a horizontal plane is angularly displaced about a line perpendicular to the microphone's horizontal longitudinal axis.

11 Claims, 8 Drawing Figures

FIG. 7
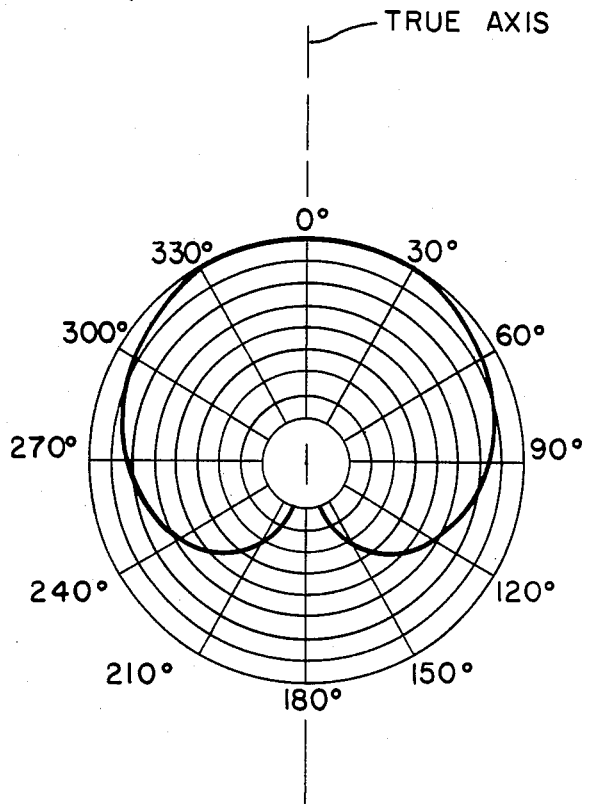
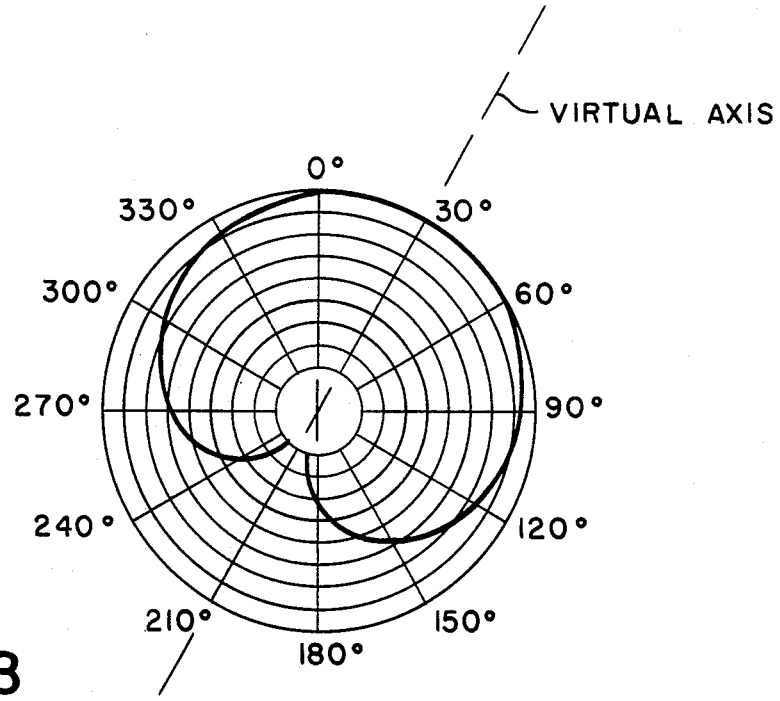
FIG. 8

MICROPHONE WITH NON-SYMMETRICAL DIRECTIVITY PATTERN

BACKGROUND OF THE INVENTION

1. Field of the Invention

This invention relates to directional microphones. In particular, the invention relates to a directional microphone having a non-symmetrical pickup pattern.

2. Description of the Prior Art

In general, there are two well known types of microphones, i.e., nondirectional (omnidirectional) and directional. Omnidirectional microphones pick up sound from all directions and are used in environments where ambient sound is not a problem. Directional microphones pick up sounds primarily from one direction or area and are particularly used where there are environmental noise problems, where maximum gain-before-feedback is required, or where there are great distances from microphone to sound source.

The cardioid pickup pattern is a well known response pattern for directional microphones, characterized by maximum pickup sensitivity or response for sound coming from the desired direction, known as "on-axis", with diminishing response for sound coming from other directions. For a true cardioid pattern, the response is down, e.g., 6 dB at 90 degrees to on-axis, and has a "null" at 180 degrees to on-axis. There are many known variations of the cardioid pattern, but in general these characteristics occur.

Currently known cardioid and cardioid-family microphones have uniformly symmetric response curves with respect to rotation of the microphone about its longitudinal axis. Any deviation from this uniformity has generally been viewed as an undesirable feature, to be avoided or corrected when present.

In some applications, however, a microphone is not used with nor can it be used with its longitudinal axis aligned with the direction from which the desired sound is coming. For example, a professional singer or radio broadcaster may position a cardioid microphone so that the voice is on-axis, utilizing the maximum pickup sensitivity of the microphone. For a television broadcaster to do so, however, would cause the microphone to be held in an awkward position which appears unnatural or uncomfortable and which prevents an unobstructed camera angle of the person speaking and holding the microphone.

In many other situations, a directional microphone is rigidly mounted in a spaced relationship from a particular sound source, but for some reason, the microphone cannot be aimed at the sound source, such as in an airplane cockpit microphone mounted on a control panel for use in a flight recorder system, also known as a "black box" system.

In each of these situations, the sound source cannot be placed on-axis, and thus the maximum pickup sensitivity of the microphone is not utilized. In fact, maximum pickup is provided in a direction of unwanted sound. Due to the symmetry of known cardioid microphones and the uniformity of symmetry in all planes, off-axis pickup on one side of the microphone gives the same performance as on any other side. This invention relates to the problem of improving off-axis sensitivity of cardioid and cardioid-family microphones when the sound source can be accurately placed in a particular side of the microphone, albeit still off-axis.

OBJECTS OF THE INVENTION

Broadly, it is an object of this invention to provide an improved directional microphone for applications where the sound source is not on axis but can be predictably located on a particular side of the microphone. In particular, an object is to provide a cardioid-type microphone specially adapted for use in situations such as, but not limited to, television broadcasting with hand-held microphones, and aircraft cockpit flight recorder systems.

Another object of the invention is to provide a cardioid-type microphone of the electret type having a non-axially-symmetrical directivity pattern in a predetermined plane.

Another object is to provide a directional transducer with improved off-axis response, suitable for use in a stereo microphone.

Still another object is to provide a stereo microphone having two transducers, where each of the transducers has improved off-axis response in respective given directions, and increased off axis rejection in other respective given directions, permitting eliminating an acoustic shield between the transducers.

SUMMARY OF THE INVENTION

These and other objects of the invention are achieved in an electret condenser microphone having a damping plug and a diaphragm. The diaphragm is positioned adjacent to a front face of the damping plug, and in rim contact with it through a diaphragm mounting ring. An internal cavity is defined by a space between the front face of the damping plug and the diaphragm. Sound impinges on a front side of the diaphragm through a number of capacitor housing openings, and, according to the invention, also on the rear side of the diaphragm, through a single special arcuate aperture or notch in the adjacent front face of the damping plug, the notch being adapted to permit sound to enter the internal cavity adjacent the back side of the diaphragm. Sound reaches the arcuate aperture by entering ports in the side wall of the capacitor housing, and then traveling in a space between the housing wall inner surface and the damping plug outer surface.

BRIEF DESCRIPTION OF THE DRAWINGS

The foregoing brief description, as well as further objects, features and advantages of the invention will be more completely understood from the following detailed description of a preferred, but nonetheless illustrative embodiment of the invention, taken together with the accompanying drawings, in which:

FIG. 7 is a typical cardioid polar response pattern; and

FIG. 8 is a polar response pattern of a microphone according to the invention.

DESCRIPTION OF THE PREFERRED EMBODIMENTS

Figure 1:
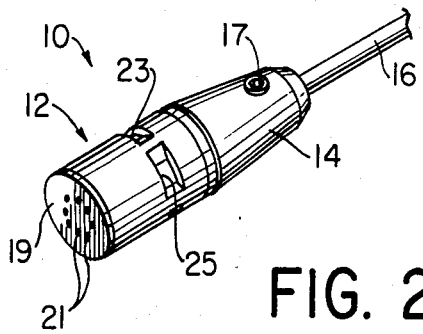
FIG. 1 is a perspective view of a microphone according to the invention.

FIG. 1 shows an illustrative electret microphone 10 according to the invention. External features generally common to microphones of this type are the capacitor housing 12, which may be assembled to a threaded portion 13 of a rear case 14. In this example a cable 16 for providing electrical power and transmitting electrical sound signals is shown entering the rearward end of the rear case 14, and the cable 16 may be held in place within the rear case 14 by a set screw 17. Conventional through holes 21 for sound are located on the front outer face 19 of the capacitor housing 12. These features are well known and numerous variations, modifications and substitutions are common.

The capacitor housing 12 in this specific example is in the general shape of a cylinder, and the cylinder wall 15 has a number of openings or ports 23,25 spaced around its circumference. Through the ports 23,25 may be seen the outer surface of a retaining ring 40, more fully described below.

According to one aspect of the invention, one of the ports 25 may be of slightly different proportions than the other ports 23, the significance of this difference to be more fully explained below. Other means for differentiating one point or area on the side of the capacitor housing 12 may be used instead, such as, for example, a colored mark or a groove.

Figure 2:
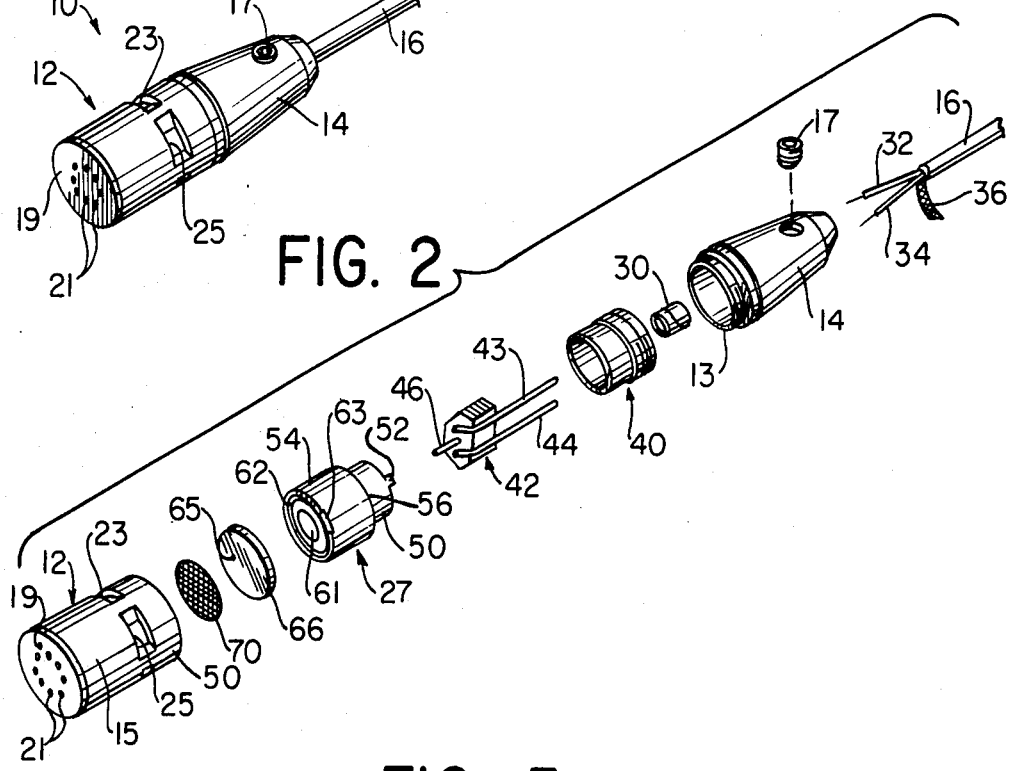
FIG. 2 is an exploded perspective view of the microphone of FIG. 1.

Referring to FIG. 2, the internal parts and features of the microphone of the invention are shown. Customary features which may (but need not necessarily) be used in a microphone according to the present invention include a banding clamp 30 for providing strain relief for cable 16 and for securing cable shield 36 within the rear case 14, an FET transistor 42 (which in this specific illustrative example is SANYO part number 2SK156), and which is electrically and mechanically connected through leads 43,44 to power and signal wires 32,34 of the cable 16, a diaphragm 65 which serves as the moving electret capacitor element for sensing sound in a microphone of this particular type, and a damping cloth 70 located in front of the diaphragm 65. The diaphragm 65 of this particular illustrative embodiment may be made of metallized FEP (fluorinated ethylene propylene), and is given a permanent electrical charge on the order of several hundred volts. While this particular embodiment of the invention relates to an FET (field effect transistor) transistor electret condenser microphone, the invention is not limited to this type of microphone, and may be applicable to any broad category of microphones, including dynamic (moving magnet) microphones.

A feature of the microphone embodying certain aspects of the invention is the damping plug 27, which may be molded or formed from a nonconductive plastic material. As is shown in FIG. 2 damping plug 27 has a rear portion 50 which may have a tab 52 extending rearwardly from it, and a front portion 54. Damping plugs, in general, are customary in electret condenser microphones. According to the electret principle, the damping plug 27 houses or is formed by means for sensing movement of the diaphragm 65, in this case the stationary electrically conductive backplate 61, together with diaphragm 65, which together constitute the variable microphone capacitor. Backplate 61 may be positioned centrally on the front face 60 of the damping plug 27, as shown. The front face 60 may additionally have an annular groove 62 formed therein and located circumferentially around backplate 61, thus forming an outer annular land 58. The volume of the annular groove 62 is part of the internal cavity 80 described more fully below. According to the invention, outer annular land 58 is interrupted by one or more non-symmetrically located arcuate depressions or notches 63, extending radially inwardly from the extreme outer edge of annular land 58 to annular groove 62. It is only required that this recessed portion or notch 63 permit sound to enter a space between backplate 61 and diaphragm 65, when assembled. Additionally, notch 63 may be aligned radially with tab 52, for purposes described below. The recessed portion 63 of the annular land 58 is preferrably recessed to a depth on the order of two thousandths of one inch (0.002").

Figure 3:
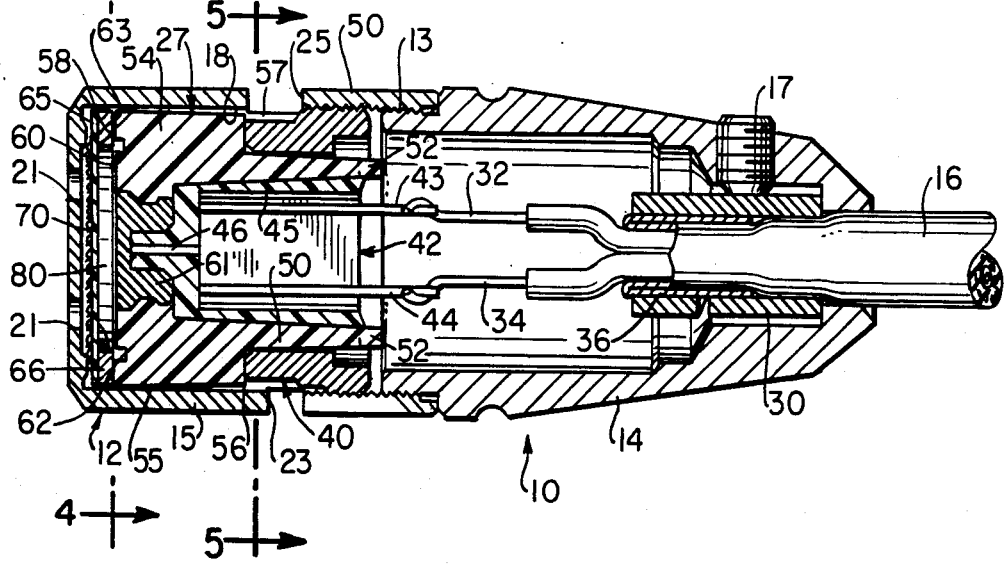
FIG. 3 is a longitudinal cross-sectional view of the microphone of FIG. 1.

Referring now to FIG. 3, additional inventive features of the illustrative microphone are shown. The microphone 10 is shown fully assembled in cross section. Damping plug 27 is seen to have a through bore 45, blocked at the forward end by backplate 61. Backplate 61 may be integrally molded into damping plug 27. FET transistor 42 may be permanently potted in bore 45 after the gate lead 46, in this example, has been electrically and mechanically secured to the rear of the backplate 61.

Retaining ring 40 may threadedly engage the capacitor housing 12, centering and pressing damping plug 27 forward into the capacitor housing 12. The outer diameter of retaining ring 40 is slightly reduced in the vicinity of housing ports 23,25 and from there forward, thus providing an annular space 57 between the retaining ring 40 and the inner wall 18 of the housing 12. The front portion 54 of damping plug 27 is tapered, in this example having decreasing outer diameter from its front annular surface 58 to the rearmost outer edge 56 of the the front portion 54, thus forming an annular space 55 around the damping plug 27, the annular space 55 communicating with the annular space 57 around retaining ring 40, which in turn communicates to the outside through the ports 23,25.

Figure 6:
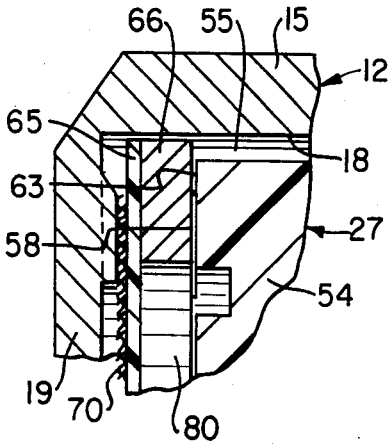
FIG. 6 is a greatly enlarged partial sectional view of the microphone of FIG. 1 taken along line 6—6 of FIG. 4.

Notch 63, having a depth on the order of one to three thousandths of an inch, provides the required communication between space 55 and the cavity 80 formed between diaphragm 65 and capacitor backplate 61. As is shown, except at the location of notch 63, a diaphragm mounting ring 66 is in pressing contact with the rim of the front land 58 of damping plug 27 and together comprise one embodiment of mounting means for positioning backplate 61 and diaphragm 65 in a spaced apart relationship. Referring briefly to FIG. 6, a greatly enlarged view of the microphone is shown, in cross section at the area of notch 63. Notch 63 is here more clearly shown providing the necessary communication between annular space 55 and internal cavity 80.

Figure 4:
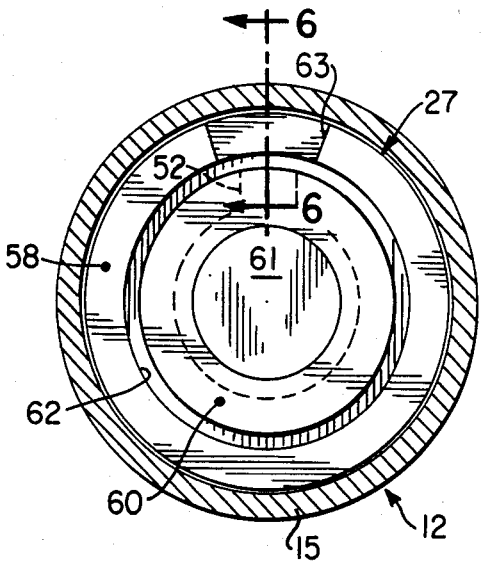
FIG. 4 is a sectional view of the microphone of FIG. 1 taken along line 4—4 of FIG. 3.

Referring to FIG. 4, one illustrative example of the notch 63 is more clearly defined. Capacitor housing 12 is separated from damping plug 27 by the small annular space 55. Damping plug 27 is shown, having the outer land 58, annular groove 62 and backplate 61 making up its front surface 60. Notch 63 covers an arc on the order of 40 degrees, cutting completely across front land 58, and may be aligned with tab 52 of the damping plug rear portion 50, here shown in phantom.

Figure 5:
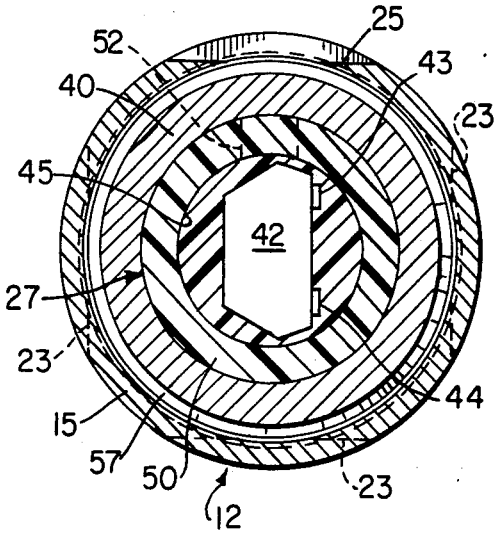
FIG. 5 is a sectional view of the microphone of FIG. 1 taken along line 5—5 of FIG. 3.

FIG. 5 shows, in cross section, the arrangement and interaction of the ports 23,25, annular space 57, and retaining ring 40, which is customary.

Thus, one specific illustrative example of a directional microphone is described which has a non-symmetrical directivity pattern. An inventive performance feature of this microphone is that its polar response curve, from on-axis to 360 degrees, varies depending upon the rotational alignment of the microphone along its longitudinal axis.

For example, as shown in FIG. 7, a customary polar response curve for a cardioid microphone might have characteristics in a plane containing its longitudinal axis as follows:

| | |
|---|---|
| 0 degrees (on-axis) | 0 dB down |
| 30 degrees off-axis (to either side) | 2 dB down |
| 90 degrees off-axis (to either side) | 6 dB down |
| 150 degrees off-axis (to either side) | 15 dB down |
| 180 degrees (null) | 27 dB down |

This pattern would normally hold true for all rotational planes containing the microphone's longitudinal axis.

Directional microphones according to the present invention do not exhibit this uniformity of symmetry in a horizontal plane as the microphone is rotated about a horizontal longitudinal axis. For example, if notch 63 is positioned directly above or below the microphone's horizontal longitudinal axis on a line perpendicular to the axis, a symmetric cardioid polar response curve, having characteristics such as above, may be obtained in the horizontal plane. But when the notch 63 is positioned on such a line which is less than 90 degrees from the horizontal, a new and unique phenomenon is observed, namely, microphone response is markedly improved on one side, and correspondingly deteriorated on the other. An illustrative response curve of a microphone of the invention in a horizontal plane is shown in FIG. 8. As can be seen, the pattern in the horizontal plane (which in this example is a cardioid pattern) is angularly displaced about a line perpendicular to the microphone's longitudinal axis. The point of maximum pickup sensitivity is thus off to one side of the physical or true on-axis direction.

A line drawn through the axis of front-to-back rotation which passes through this new maximum point may be termed the "virtual axis". Similar to a conventional cardioid pattern, microphone sensitivity decreases in either direction off the virtual axis, resulting in a true on-axis response which may be, for example, 1–2 dB down from the virtual axis response. In similar angularly displaced fashion, a null correspondingly occurs at 180 degrees off the virtual axis. This principle can be applied to microphones having a variety of other response patterns, such as super- and hyper-cardioid patterns, in which cases the corresponding nulls may occur in their normal relationship to the virtual axis, wherever these points may fall with respect to the true longitudinal axis.

The response pattern is angularly displaced the greatest amount, in this example, when the plane of front-to-back rotation passes through the center of the notch 63, with the virtual axis occurring on the side away from the notch. Thus the directional microphone according to the invention is seen not only to enhance off-axis performance on one side, but also improves off-axis rejection of sound from the other side. Many specific applications for microphones can benefit from this unique characteristic.

For instance, two microphones as described above could be positioned side by side, with the strong response directions set opposite and facing away from each other. Due to the modified cardioid polar response pattern, each will be highly sensitive to sound coming from one respective side off-axis. Furthermore, the weak side of the response pattern for each will cover areas for which the other microphone is primarily responsible, automatically enhancing the stereo effect, without either aiming the indivual microphones apart, or the use of acoustic shielding between the two.

As noted above, damping plug 27 may have a tab 52 which is aligned with notch 63. During assembly of the illustrative microphone just described, tab 52 may be oriented to line up with the slightly larger port 25 of the capacitor housing 12. In this way, a simple visual reference mark is provided so that the user can properly orient the microphone with the virtual axis (strong off-axis) side facing the expected direction of desired sound.

While one particular microphone has been described, it will be understood that many modifications are possible without departing from the spirit of scope of the invention, limited only by the appended claims.

We claim:

1. A microphone comprising:

a diaphragm for sensing sound pressure waves, said diaphragm having a front side and a rear side;

means for sensing forward and rearward movement of said diaphragm, said movement sensing means including an electrically conductive element mounted in spaced relationship to the rear side of said diaphragm so as to define therebetween a cavity;

a damping plug member for positioning said movement sensing means in said spaced relationship, said damping plug member substantially enclosing said cavity; and a diaphragm mounting member attached to said diaphragm, said damping plug member being in pressing contact with diaphragm mounting member, said damping plug member further having a non-symmetrical arrangement of at least one aperture for permitting sound pressure waves to enter said substantially enclosed cavity at substantially a peripheral edge of said cavity, said at least one aperture extending between said diaphragm mounting member and said damping plug member.

2. A microphone according to claim 1, wherein said diaphragm is substantially circular, and has an electrical charge.

3. A microphone according to claim 1, wherein said diaphragm is substantially circular, said diaphragm mounting member is attached in rim contact to said diaphragm, and wherein said pressing contact between said diaphragm mounting member and said damping plug member occurs at an annular land on a front surface of said damping plug member.

4. The microphone according to claim 3, wherein said damping plug member has only a single aperture.

5. A microphone according to claim 4, wherein said aperture is defined on a side by a recessed portion of said annular land, and on another side by said diaphragm mounting means.

6. A microphone according to claim 5, wherein said recessed portion is recesses a depth on the order of two thousandths of an inch.

7. A microphone according to claims 1 or 6, wherein said movement sensing means includes a field effect transistor.

8. A microphone according to claim 7, further comprising:

a housing having a front surface and a side surface, said front surface having at least one opening for permitting sould pressure waves to impinge on the front side of said diaphragm via a first sound path, when said diaphragm is mounted inside said housing, said housing also having a differentiated side part for permitting sound pressure waves to impinge on the rear side of said diaphragm via a second sound path, said second sound path passing through said at least one aperture, said differentiated side port also identifying a predetermined side of said microphone having maximum acoustic sensitivity.

9. In an electret capacitor microphone having means for creating an interior cavity for providing said microphone with a directional response pattern, the improvement comprising a non-symmetrical arrangement of at least one aperture in said means, said aperture communicating at one end with a radially peripheral edge of said interior cavity and at the other end with outside the microphone.

10. A microphine according to claim 9, wherein said microphone has a longitudinal axis, said longitudinal axis being angularly displaced from a virtual axis of acoustic response substantial symmetry defined by the direction of maximum pickup sensitivity of said microphone.

11. A microphone according to claim 10, wherein said response pattern is a cardioid response pattern and a cardioid response axis of said response pattern is substantially said virtual axis.

* * * * *